US011111762B2

(12) United States Patent
Hales et al.

(10) Patent No.: US 11,111,762 B2
(45) Date of Patent: Sep. 7, 2021

(54) METHOD AND DEVICE FOR MULTILATERAL SEALED JUNCTIONS

(71) Applicant: Halliburton Energy Services, Inc., Houston, TX (US)

(72) Inventors: John Hudson Hales, Choctaw, OK (US); Brett Wade Williams, Tuttle, OK (US); Joseph George Blakey, Tuttle, OK (US); Peter C. Jackson, Edmond, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 109 days.

(21) Appl. No.: 16/482,766

(22) PCT Filed: Apr. 29, 2017

(86) PCT No.: PCT/US2017/030302
§ 371 (c)(1),
(2) Date: Aug. 1, 2019

(87) PCT Pub. No.: WO2018/200008
PCT Pub. Date: Nov. 1, 2018

(65) Prior Publication Data

US 2020/0190949 A1 Jun. 18, 2020

(51) Int. Cl.
*E21B 41/00* (2006.01)
*E21B 23/06* (2006.01)
*E21B 33/12* (2006.01)

(52) U.S. Cl.
CPC ..... *E21B 41/0042* (2013.01); *E21B 23/06* (2013.01); *E21B 33/1208* (2013.01)

(58) Field of Classification Search
CPC ..... E21B 41/0035; E21B 41/0042
See application file for complete search history.

(56) References Cited

U.S. PATENT DOCUMENTS 5,322,127 A 6/1994 McNair et al.
6,012,526 A 1/2000 Jennings et al.
(Continued)

FOREIGN PATENT DOCUMENTS

EP 1428974 B1 1/2008
RU 2319826 C2 3/2008
(Continued)

OTHER PUBLICATIONS

Garrouch, A. A., et al., "An integrated approach for the planning and completion of horizontal and multilateral wells," Journal of Petroleum Science and Engineering 44, pp. 283-301, Mar. 12, 2004, Elsevier.

*Primary Examiner* — Kristyn A Hall
(74) *Attorney, Agent, or Firm* — Scott Richardson; Parker Justiss, P.C.

(57) ABSTRACT

This disclosure provides a dissolvable sealing joint system that can be used in an improved method of sealing a multi-lateral well junction. The sealing joint system is comprised of a dissolvable junction subassembly that can be easily removed after a sealing operation is conducted. A tapered end of the dissolvable junction subassembly is inserted in a liner of a secondary wellbore, and a seal located about the tapered end is sealed against the top of the liner and a no-go shoulder of dissolvable junction subassembly. Once a seal is established, an isolation fluid is pumped into the junction area via a fluid port located in the dissolvable junction subassembly. A method of isolating a wellbore junction is also presented.

19 Claims, 9 Drawing Sheets

(56) References Cited

U.S. PATENT DOCUMENTS

| | | | | |
|---|---|---|---|---|
| 6,015,012 | A | 1/2000 | Reddick | |
| 6,079,493 | A | 6/2000 | Longbottom et al. | |
| 6,138,761 | A * | 10/2000 | Freeman | E21B 33/124 166/313 |
| 6,209,644 | B1 | 4/2001 | Brunet | |
| 6,712,144 | B2 | 3/2004 | Buytaert | |
| 8,220,554 | B2 | 7/2012 | Jordan et al. | |
| 9,284,821 | B1 | 3/2016 | Albertson | |
| 2003/0085037 | A1 | 5/2003 | Roane et al. | |
| 2016/0376869 | A1* | 12/2016 | Rochen | E21B 29/02 166/135 |
| 2019/0234163 | A1* | 8/2019 | Glaser | E21B 41/0035 |

FOREIGN PATENT DOCUMENTS

| | | | |
|---|---|---|---|
| RU | 2455466 | C1 | 7/2012 |
| WO | 9809053 | | 3/1998 |
| WO | 9809054 | | 3/1998 |
| WO | 2004044375 | A1 | 5/2004 |

* cited by examiner

METHOD AND DEVICE FOR MULTILATERAL SEALED JUNCTIONS

CROSS-REFERENCE TO RELATED APPLICATION

This application is the National Stage of, and therefore claims the benefit of, International Application No. PCT/US2017/030302 filed on Apr. 29, 2017, entitled "IMPROVED METHOD AND DEVICE FOR MULTILATERAL SEALED JUNCTIONS," which was published in English under International Publication Number WO 2018/200008 on Nov. 1, 2018. The above application is commonly assigned with this National Stage application and is incorporated herein by reference in its entirety.

BACKGROUND

Multilateral well systems are well known in the oil and gas industry. Generally, a multilateral well system includes a parent wellbore formed through a formation and one or more lateral or secondary wells that extend from the parent wellbore into the adjacent formation. Multilateral well systems enjoy several advantages, including, among others, higher production indices, which increases profitability on low producing wells. However, there are several problems facing the operator when drilling multilateral completions. One of the most significant issues is the junction from the parent wellbore to the secondary wellbore, or the junction from a secondary wellbore to another tertiary wellbore. Without a good seal between the lateral and parent wellbores, the junction is highly problematic in that it may close, partially close, or collapse, which can and prevent or complicate reentry, as well as preventing production from flowing out of the lateral wellbore. Further, an improperly sealed junction may not allow effective zone isolation, which is an important component to well completion, and an improperly sealed junction is prone to undesirable sand intrusion from unconsolidated sand surrounding the wellbore.

DETAILED DESCRIPTION

Figure 1:
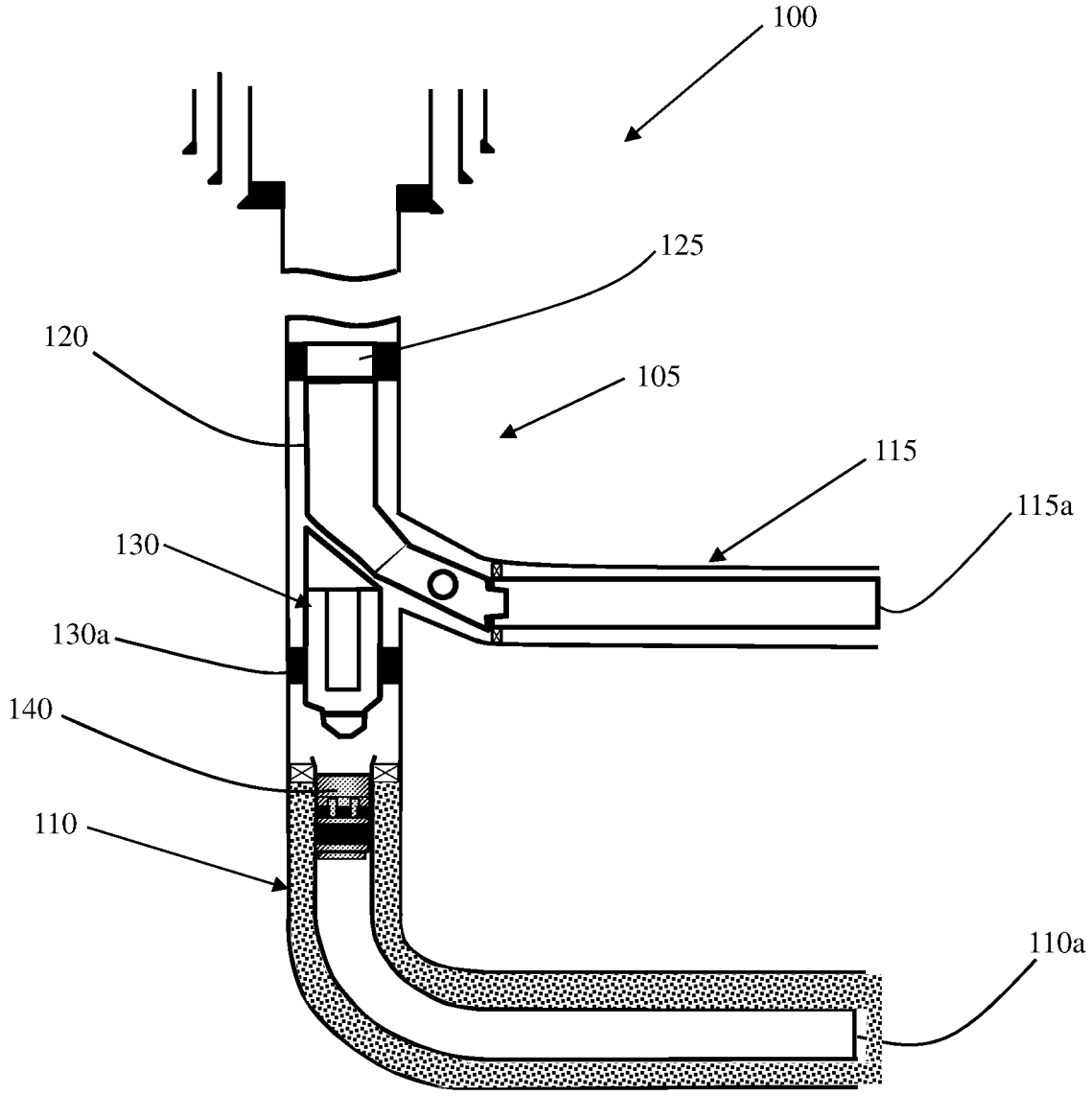
FIG. 1 illustrates a wellbore system and a dissolvable well sealing joint system, as provided herein.

This disclosure, in its various embodiments, provides a dissolvable sealing joint system that can be used in an improved method of sealing a multilateral well junction. The sealing joint system is comprised of a dissolvable junction subassembly that can be easily removed after a sealing operation is conducted. The isolation fluid is pumped into the junction area through a fluid port of the junction subassembly. The junction subassembly is designed and built from examples of the materials discussed herein to allow the appropriate standoff, allowing a material to flow through and around the junction subassembly, thereby sealing the sidewalls of the wellbore, which significantly reduces the chance of wellbore closure due to collapse. As used herein and in the claims, the term "dissolve," and grammatical variations thereof, includes both chemical dissolution and physical disintegration, such as drilling-out, milling, or grinding of the recited component.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect connection or interaction between the elements described, as well. As used herein and in the claims, the phrase "configured" means that the recited elements are connected either directly or indirectly in a manner that allows the stated function to be accomplished. These terms also include the requisite physical structure(s) that is/are necessary to accomplish the stated function.

In the following discussion and in the claims, the terms "including" and "comprising" are used in an open-ended fashion, and thus should be interpreted to mean "including, but not limited to." References to "up" or "down" are made for purposes of general special location relative to the recited components, with "up," "upper," or "uphole," meaning toward the surface of the wellbore and with "down," "lower," "downward," "downhole," or "downstream" meaning toward the terminal end of the well, as the tool would be positioned within the wellbore, regardless of the wellbore's orientation. These terms or phrases do not, however, require that the tool be positioned in a wellbore when determining the meaning of the claims, unless specifically stated otherwise, but are used for general reference as to the components' orientations to each other as they would be when positioned in a wellbore. A "wellbore" as used herein and in the claims, may be any type of wellbore that is associated with both production and non-production wellbores, including exploration wellbores or injection wellbores. Moreover, a wellbore is not limited to oil and gas wellbores, but include other types of wellbores used to recover various fluids, regardless of viscosity, from the earth.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 generally illustrates a wellbore system 100 in which a dissolvable well junction sealing system 105 is positioned to seal a junction between a parent wellbore 110 and a secondary wellbore 115. As used herein and in the claims, a "parent wellbore" is the wellbore from which a deviated wellbore is drilled, and as such, is the wellbore in which a whip stock is placed to deviate a drilling bit in the desired lateral direction. As used herein and in the claims, a "secondary wellbore" is the deviated or lateral wellbore. It should be understood that in certain well systems, a tertiary deviated or lateral wellbore may also be drilled off the secondary wellbore, and in such cases, the secondary wellbore would be a parent wellbore. The parent and secondary wellbores 110, 115 may be cased holes or open holes that are lined with liners 110*a*, 115*a* that have been cemented into placed or otherwise isolated by mechanical means, such as an open hole, inflatable or swellable packer.

The dissolvable well junction sealing system 105 includes a dissolvable junction subassembly 120 that may be coupled to a conventional dissolvable packer or a cement plug, generally designated 125. The packer/cement plug 125 may be constructed of conventional materials that allow the packer/cement plug 125 to be drilled-out with a drill bit, or in other embodiments, it may be comprised of the same or similar dissolvable material from which the junction assembly is made. In another embodiment, the dissolvable well junction sealing system 105 may include a whip stock 130 that includes a packing element 130*a* that is used to set the whip stock 130 in place. Typically, the whip stock 130 is seated above, on, or in the liner 110*a* of the parent wellbore 110 and is used to deflect the drilling bit in the desired direction during the drilling of the secondary wellbore 115. The whip stock 130 may be of conventional design, or it may be dissolvable, as discussed herein regarding the dissolvable well junction sealing system 105. In one configuration, the dissolvable well junction sealing system 105 may also include a temporary, dissolvable bridge plug 140 that is set inside the liner 110*a* of the parent wellbore 110 to isolate the liner 110*a*.

Figure 2:
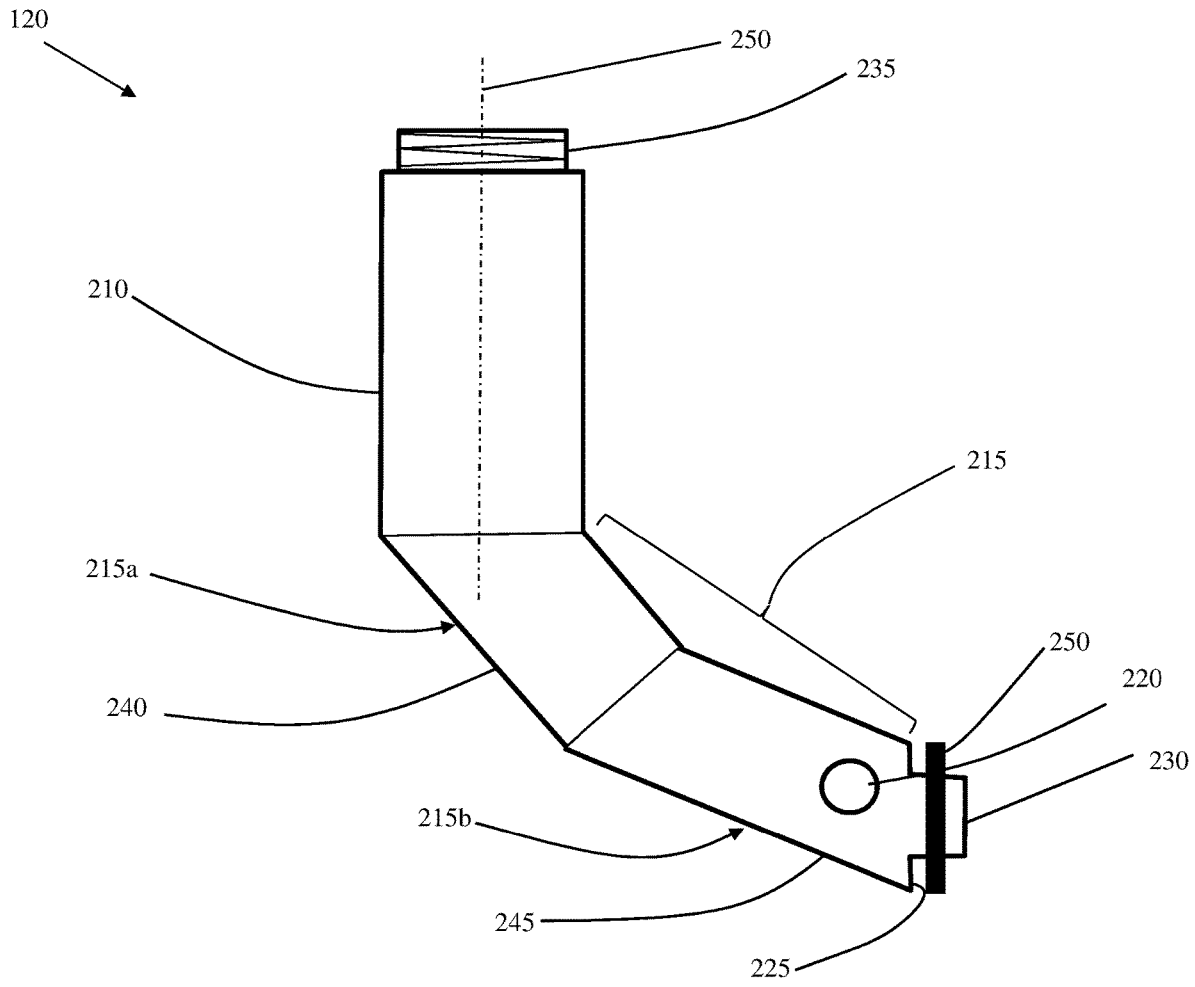
FIG. 2 illustrates an embodiment of a dissolvable junction subassembly of the dissolvable well sealing joint system.

FIG. 2 illustrates one configuration of an embodiment of the dissolvable junction subassembly 120 that forms a portion of the dissolvable well junction sealing system 105. It should be noted that the geometric configuration of the dissolvable well junction sealing system 105 may vary from the embodiment shown, and its design will depend on the downhole application. In one embodiment, the junction subassembly 120 has an upper hollow portion 210 and lower portion 215. A fluid port 220 is located in the lower portion 215 in the illustrated embodiment. However, in other embodiments, the fluid port 220 may be located in the upper portion 210. The lower portion 215 also includes a no-go shoulder 225 that defines a tapered end 230. The fluid port 220 may be of conventional design, for example it may be a tubing sub that is ported, allowing flow from the inner diameter through the port to the outer diameter of the junction subassembly 120, or in another embodiment, it may include a conventional check valve. A "no-go" shoulder is a shoulder that prevent one component from moving any further with respect to another component that the no-go should engages.

The tapered end 230 is used to "sting" or insert into the secondary wellbore. The hollow portions 210 and 215 allow an isolation fluid, such as cement, to be pumped through the upper hollow portion 210 and out of the junction subassembly 120 through fluid port 220 and into the surrounding well annulus. Though cement is a common isolation fluid in the oil and gas industry, other known isolation fluid compositions, include, but are not limited to cement, resin, elastomer, cement/resin and cement/elastomer compositions, foam cement or standard cement having micro-granular particles that are capable of setting up and hardening downhole. The fluid port 220 may be fixed in an open position, or it may include an opening and closing mechanism of conventional design, such as a check valve, as mentioned above.

The junction subassembly 120 may be molded, including injection molding, or milled from the material that comprises the junction subassembly 120. In one embodiment, the junction subassembly 120 is comprised of the upper hollow portion 210 with its lower end connected to at least one or more connected or integrally formed sections 215*a*, 215*b* that form the lower portion 215 of the junction subassembly 120. The connections may be of conventional design, such as threaded connections 235, that are used to connect the junction subassembly 120 to a packer or cement plug, as previously discussed. As noted above, the one or more sections 215*a*, 215*b* may also be hollow, which provide an embodiment that has less material that needs to be dissolved once the well junction is properly sealed. However, in other embodiments, the fluid port 220 may be located in the upper portion 210 and the lower portions 215*a* and 215 may be solid. In such instances, the upper hollow portion 210 may be fluidly isolated from the lower sections 215*a*, 215*b* to prevent the isolation fluid from entering the lower sections 215*a*, 215*b*.

In another embodiment, the junction subassembly 120 may be a unitary, integrally formed body. For example, the junction subassembly 120 may be milled or molded into a single hollow piece or body. In an embodiment where the junction subassembly is made of a rigid material, the junction subassembly 120 may include one or more angled faces 240, 245, that are angled with respect to a central axis 250 of the junction subassembly 120. The angled face or faces 240, 245, give the junction subassembly 120 an angled orientation, which helps guide it into the secondary wellbore.

The junction subassembly 120 also includes a sealing member 250, such as a rubber O-ring or dissolvable element, located about the tapered end 230 thereof and adjacent the no-go shoulder 225. The sealing member 250 works in conjunction with the no-go shoulder 225 to seal against the polish bore of the liner of the secondary wellbore and prevent the isolation fluid from entering into the secondary wellbore liner tubing.

As noted above, the junction subassembly 120 is dissolvable. In one embodiment, the junction subassembly 120 is comprised of known metals or metal alloys that are designed to be dissolved or easily disintegrated by drilling, milling or grinding. However, in contrast to a whip stock, the junction subassembly 120 does not have to be a high-strength device, and thus, the materials from which the junction subassembly 120 is fabricated do not need to withstand the intense pounds per square inch (psi) pressures that are required to deflect a drill bit off a whip stock. This allows the use of structurally lighter materials. Thus, in some embodiments, the junction subassembly 120 may be comprised of thinner metals, hard resin plastics and epoxies, rubber, or other synthetic materials and compositions, such as fiberglass, or a combination of any of these. For example, the upper portion 210 may be constructed from one type of material, while the lower portion 220 may be constructed on another type of material. The materials from which the junction subassembly 120 is made need only withstand the general wellbore operational and environmental conditions and the pumping pressures associated with pumping the isolation fluid into the wellbore junction area.

In one embodiment, the junction subassembly 120 is comprised of calcium, aluminum, magnesium, bismuth, indium, gallium, germanium, selenium, or tin and may include combinations or alloys of these metals. In certain embodiments, the metal alloy may include calcium-magnesium (Ca—Mg) alloys, calcium-aluminum (Ca—Al) alloys, calcium-zinc (Ca—Zn) alloys, magnesium-lithium (Mg—Li) alloys, aluminum-gallium (Al—Ga) alloys, aluminum-indium (Al—In) alloys, aluminum-gallium-indium alloys (Al—Ga—In), or combinations thereof. In such embodiments, the junction subassembly 120 may, for example, be dissolved using hydrochloric acid, nitric acids, sulfuric acid or potassium chloride.

In another embodiment, the junction subassembly 120 is comprised of an organic polymer, such as polymeric compositions. Non-limiting examples of such polymeric compositions include cross-linked polymers, such as hardened epoxy resins, thermoplastics, or elastomers, including natural and synthetic rubbers or known nano-structured materials. In such embodiments, the junction subassembly 120 may be chemically dissolved using a chemical solvent, non-limiting examples of which include tetrahydrofuran (THF), methyl acetate (MA), isopropanol and methanol or any combination thereof. Known acids, caustics, or chlorides could also be used.

The geometric dimensions of the junction subassembly 120 may vary, depending on design parameters, but in one embodiment, the tubular member 120 has a length of about 20 feet, with the upper portion 210 having a width of about 6⅛ inches. The tapered end 230 is configured to be inserted into a ½ inch casing or liner or polished bore thereof. As mentioned above, because the junction subassembly 120 does not have to withstand extreme weight pressures, the thickness of the sidewalls of the junction subassembly 120 can be much thinner, thereby reducing material and production costs.

Figure 3:
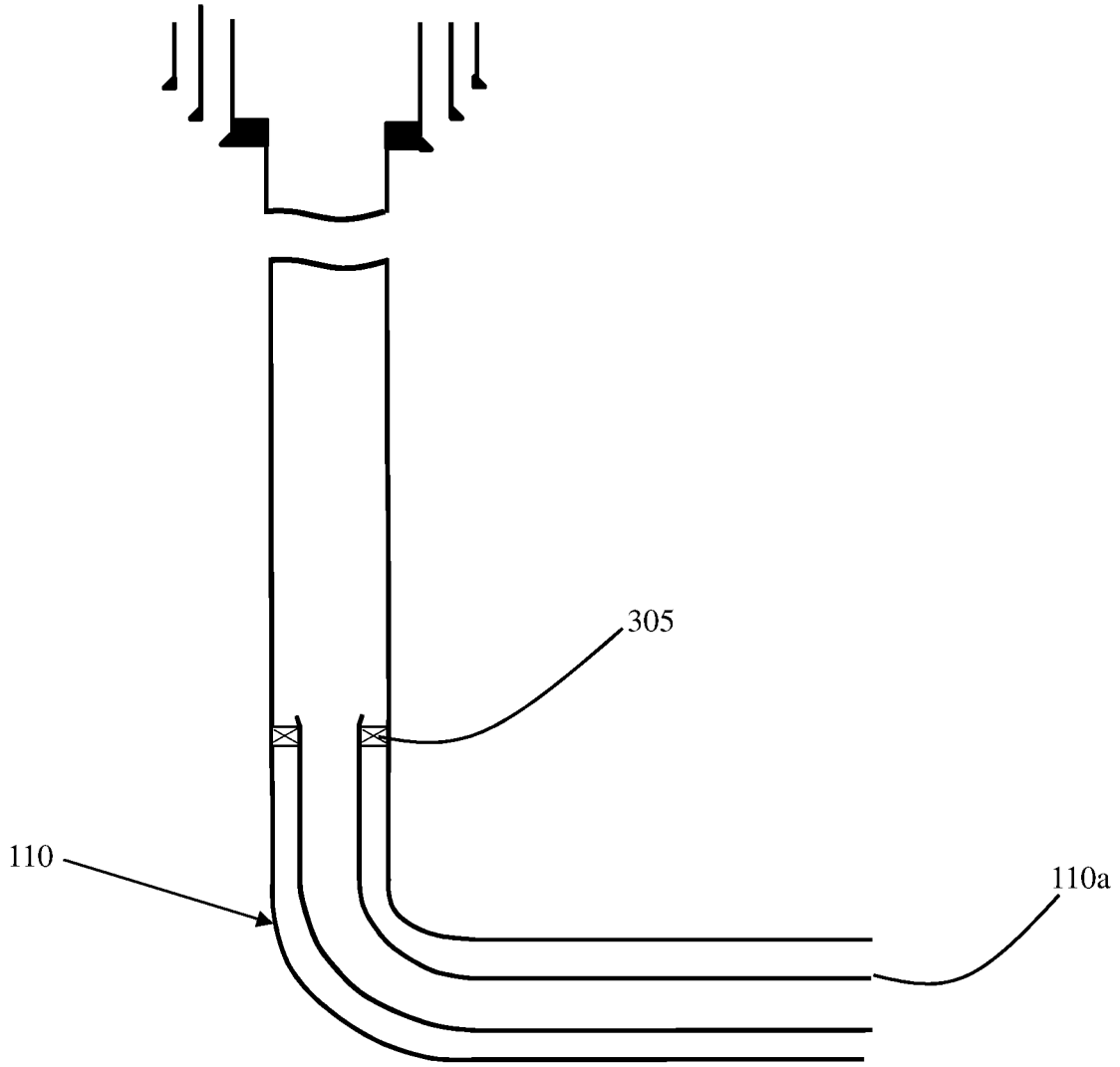
FIG. 3 illustrates an intermediate parent wellbore have a liner installed therein.

FIG. 3 illustrates the intermediate wellbore in which the dissolvable well junction sealing system 105 may be implemented. At this stage of the process, the parent wellbore 110 is drilled, after which the wellbore 110 may be cased or left as an open hole. A conventional liner hanger/centralizer 305 is placed in the parent wellbore 110, and the liner 110*a* is hung from the liner hanger 305 in the parent wellbore 110. The liner hanger 305 provides an anchoring point within the parent wellbore 110 for the liner 110*a*. The liner top will have sufficient geometry to accommodate mating seal assembly. Also, the liner top may or may not have ratch latch or latching type mechanisms.

Figure 4:
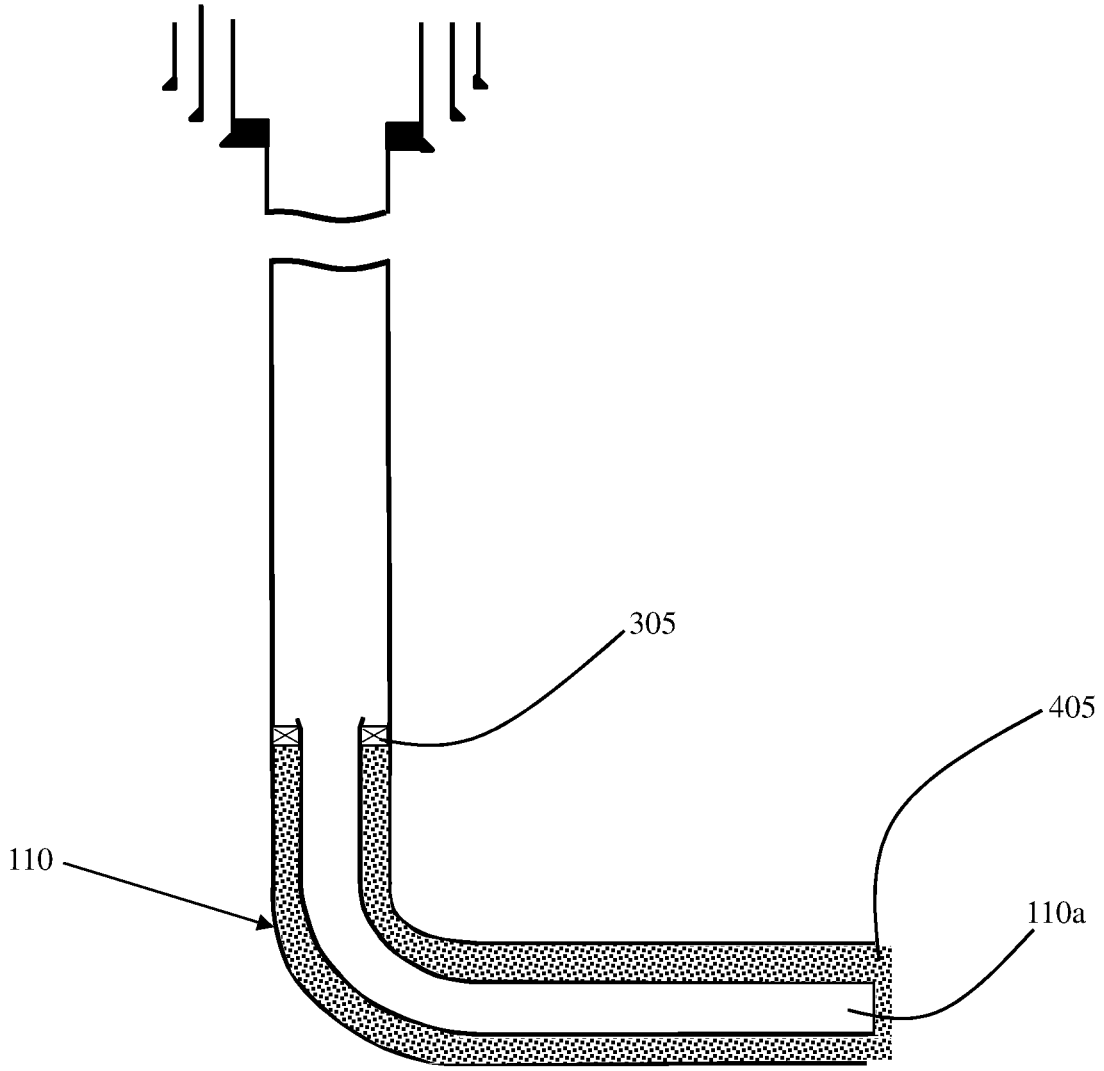
FIG. 4 illustrate the intermediate parent wellbore after the liner has been cemented into place.

FIG. 4 illustrates the intermediate parent wellbore 110 in which the liner 110*a* has been fixed in place by a conventional, hardened isolation fluid 405, such as cement, though other known hardening materials, as noted above, may also be used. Once hardened, the isolation fluid prevents movement of the liner 110*a* and keeps it central to the axis of the parent wellbore.

Figure 5:
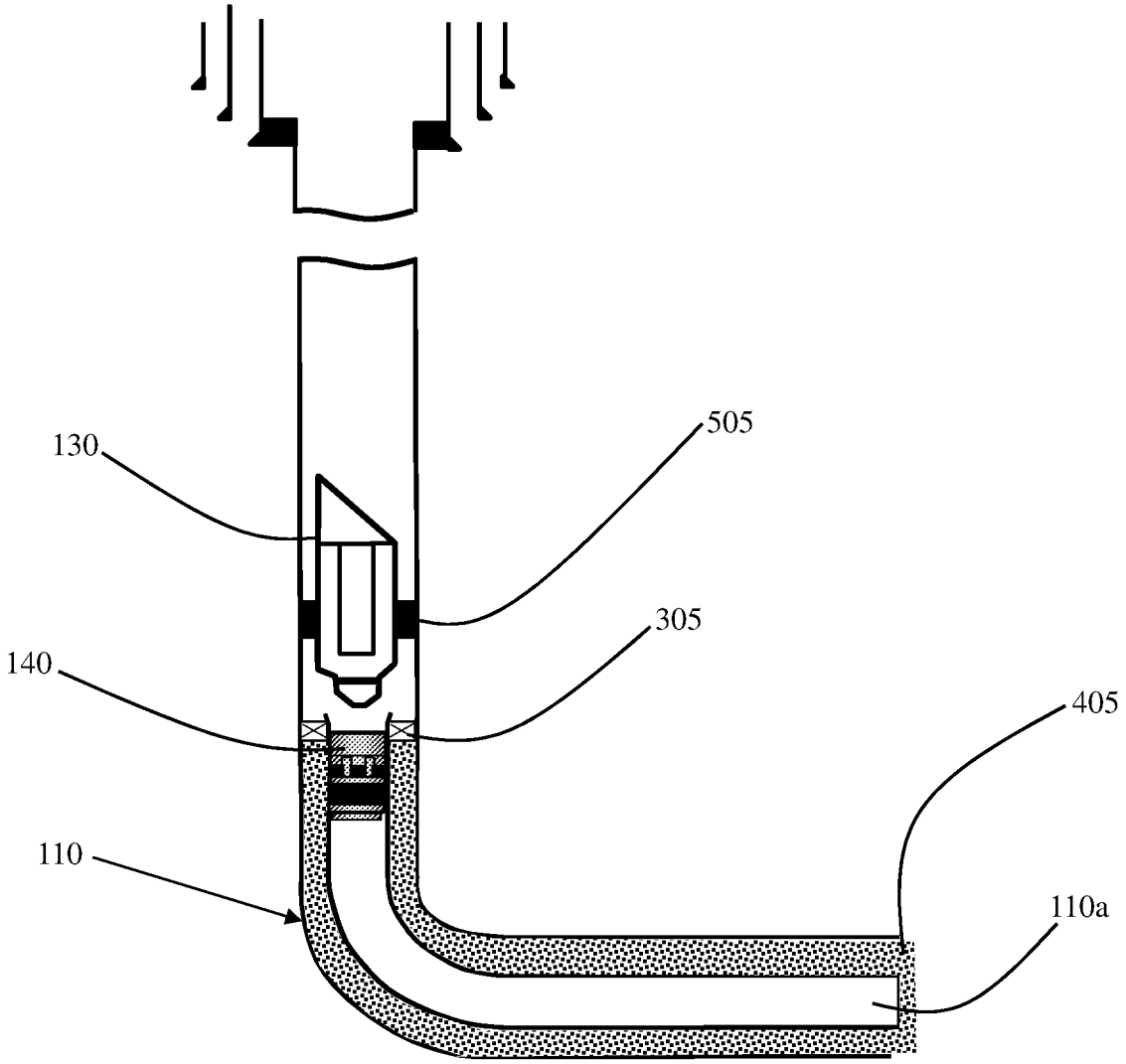
FIG. 5 illustrates the intermediate parent wellbore having a whip stock and temporary dissolvable bridge plug positioned therein.

FIG. 5 illustrates the intermediate parent wellbore 110 in which the conventional whip stock 130 and optional bridge plug 140 have been set, using a packing element 505, in the parent wellbore 110. The whip stock 130 may also be dissolvable, if desired. The whip stock 130 is positioned in the parent wellbore 110 at the appropriate depth. The whip stock's 130 deflection face is oriented to cause a drilling bit to deviate in the desired direction to form the secondary wellbore. The whip stock may be run into the hole and set via wireline or mechanically by using a drill string.

Figure 6:
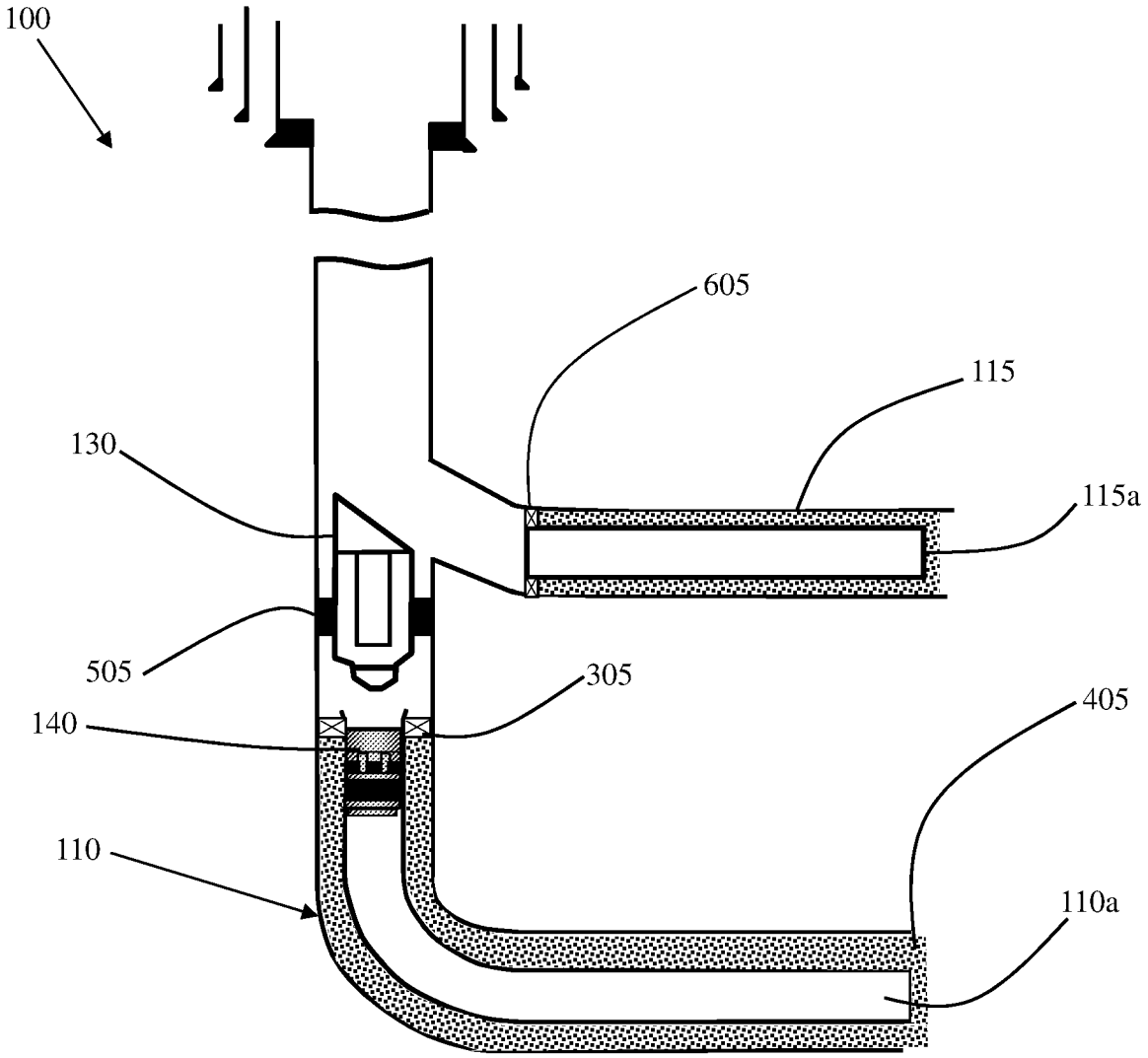
FIG. 6 illustrates the intermediate parent wellbore have the drilling of a secondary wellbore and installation of a liner therein.

FIG. 6 illustrates the intermediate parent wellbore 110 after the conventional drilling of the secondary wellbore 115. The drill bit deflects off whip stock 130, which forces the drill bit to grind though the casing, if present, or sidewall of the parent wellbore 110 in the set direction. Once sufficient lateral distance is achieved, the liner 115*a* is conventionally inserted into the secondary wellbore 115 and hung from hangers 605 and fixed into place with cement 610. At this point, if the whip stock 130 is not dissolvable, it may be removed and replaced with a dissolvable whip stock that may be chemically or mechanically removed.

Figure 7:
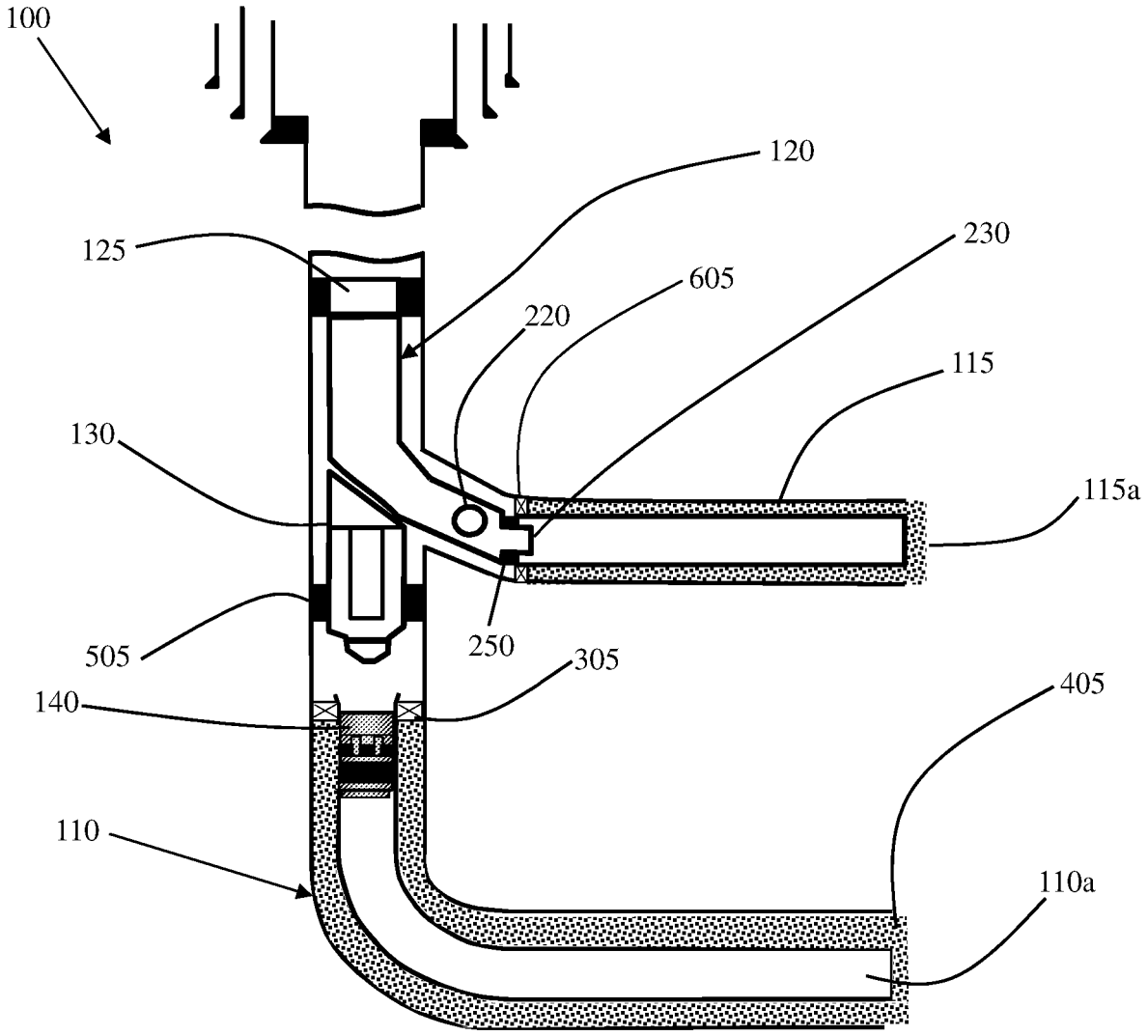
FIG. 7 illustrates the intermediate parent and secondary wellbores where a dissolvable junction subassembly is positioned in the parent wellbore and the secondary wellbore.

FIG. 7 illustrates the intermediate parent wellbore 110 and secondary wellbore 115 after an embodiment of the junction subassembly 120 is positioned within the parent wellbore 110 and the secondary wellbore 115. As illustrated, junction subassembly 120 is connected to and set in place by the packer 125. The tapered end 230 is received in the liner 115*a* and the sealing member 250 is sealed against the end of the liner 115*a*, or if the liner 115*a* is not present, then it seals against the polished bore.

Figure 8:
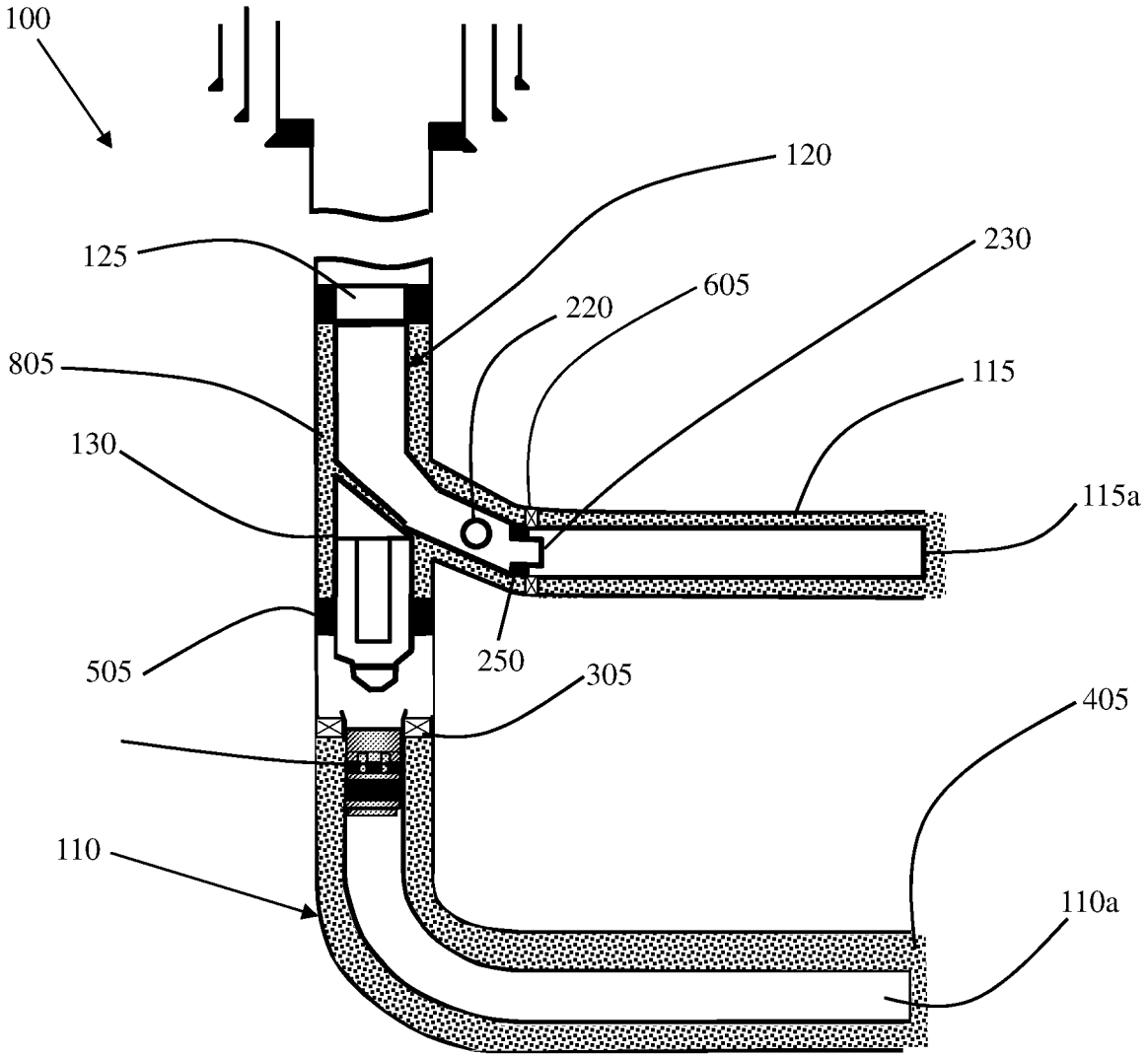
FIG. 8 illustrates the intermediate parent and secondary wellbores showing the isolation fluid positioned in the junction area.

FIG. 8 illustrates the intermediate parent wellbore 110 and secondary wellbore 115 after isolation fluid 805 is pumped into the well annulus surround the junction subassembly 120 and the whip stock 130. The isolation fluid 805 is circulated down hole and out through the fluid port 220 of the junction subassembly 120. This fills the voids around the whip stock 130 and the junction subassembly 120 and the formation. The fluid may be squeezed in to the formation as an option. Depending on the type of system deployed and the type of formation, the isolation fluid 805 may be placed via circulated/bullhead squeeze/braden head squeeze, or other method common to oilfield practices. After it hardens, the isolation fluid 805 seals the junction area.

Figure 9:
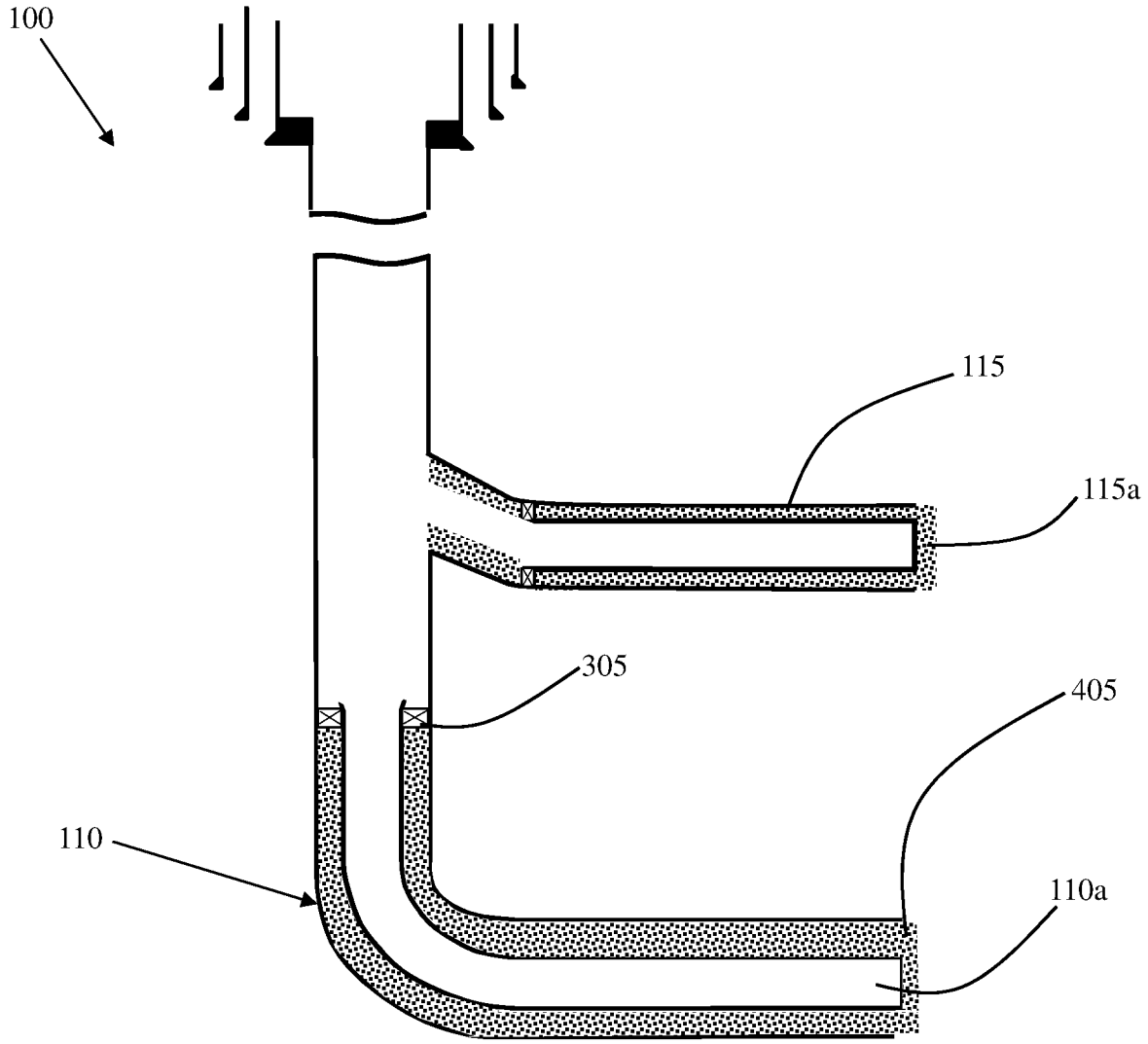
FIG. 9 illustrates the isolated junction area of the parent and secondary wellbores after the dissolution of the junction subassembly and removal of the whip stock.

FIG. 9 illustrates the wellbore system 100 after the packer 125 has been drilled out and the junction subassembly 120 dissolved and the whip stock 130 removed or dissolved, and the optional bridge plug 140, if present, is also dissolved chemically or mechanically, as defined above. The removal of the packer 125 allows access to the junction subassembly 120 by the drill bit or the catalytic solution, depending on the embodiment deployed, which dissolves the junction subassembly 120 and allows access to and removal of the whip stock 130. As shown, the hardened isolation fluid 805 seals the junction of the secondary wellbore 115, while at the same time, allowing clear access to both the parent wellbore 110 and the secondary wellbore 115. As an optional step, the bit centralizer may be used to "dress" off the isolation material and create a cleaner pathway to both the parent and secondary wellbores 110, 115.

Embodiments herein comprise:

A sealing joint system for a wellbore junction, comprising: a junction subassembly having upper and lower portions and a fluid port located therein, the lower portion having a no-go shoulder defining a tapered end; and a sealing member located about the tapered end and adjacent the no-go shoulder, and wherein the junction subassembly is comprised of a dissolvable material.

Another embodiment is directed to a method of sealing a junction between adjacent wellbores, comprising: placing a whip stock in a parent wellbore and using the whip stock to place a dissolvable sealing joint into a liner in a secondary wellbore. The dissolvable well joint is connected to a packer assembly and comprises a junction subassembly having upper and lower portions and a fluid port located therein, the lower portion having a no-go shoulder defining a tapered end; and a sealing member located about the tapered end and adjacent the no-go shoulder, wherein the junction subassembly is comprised of a dissolvable material. The method further includes pumping an isolation fluid through the fluid port to seal a junction region located adjacent the parent and secondary wellbores, dissolving the packer assembly and the junction assembly, and removing the whip stock.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the fluid port is a fixed, open port.

Element 2: wherein the junction subassembly is comprised of connectable sections, and the hollow upper portion is connected to at least one or more sections that form the lower portion of the junction subassembly.

Element 3: wherein the at least one or more sections are hollow.

Element 4: wherein the tubular is a unitary, integrally formed body.

Element 5: wherein the junction subassembly is comprised of a metal or metal alloy, elastomeric or rubber material.

Element 6: wherein the metal comprises aluminum or magnesium.

Element 7: wherein the metal alloy is calcium-magnesium (Ca—Mg) alloys, calcium-aluminum (Ca—Al) alloys, calcium-zinc (Ca—Zn) alloys, magnesium-lithium (Mg—Li) alloys, aluminum-gallium (Al—Ga) alloys, aluminum-indium (Al—In) alloys, aluminum-gallium-indium alloys (Al—Ga—In), or combinations thereof.

Element 8: wherein the junction subassembly is comprised of an organic polymer.

Element 9: wherein the organic polymer is a polymeric composition.

Element 10: wherein the polymeric material is a cross-linked polymer, thermoplastic or elastomer.

Element 11: wherein the junction subassembly is comprised of epoxy or a nano-structured material.

Element 12: wherein the lower portion includes angled sections.

Element 13: wherein the junction subassembly is coupled to a drillable packer or drillable cement plug.

Element 14: wherein dissolving includes chemical dissolution of the junction subassembly or mechanical disintegration of the junction subassembly.

Element 15: wherein dissolving comprises exposing the junction subassembly to a catalyst solution that reacts with the composition of the junction subassembly which dissolves the junction subassembly, wherein the catalyst solution is hydrochloric acid, nitric acids, sulfuric acid, potassium chloride, tetrahydrofuran (THF), methyl acetate (MA), isopropanol and methanol or any combination thereof.

Element 16: wherein mechanical disintegration comprises drilling-out the junction subassembly.

Element 17: further comprising removing the whip stock from the parent wellbore.

Element 18: further comprising removing the whip stock by chemical dissolution, mechanical disintegration, or physical removal of the whip stock from the parent wellbore.

What is claimed is:

1. A sealing joint system for a wellbore junction, comprising:

a rigid junction subassembly having upper and lower tubular portions forming a body and a fluid port located therein, the lower tubular portion having a no-go shoulder defining a tapered end; and a sealing member located about the tapered end and adjacent the no-go shoulder, and wherein at least a portion of the body is comprised of a dissolvable material.

2. The sealing joint system of claim 1, wherein the fluid port is a fixed, open port.

3. The sealing joint system of claim 1, wherein the junction subassembly is comprised of connectable sections, and the upper tubular portion is connected to at least one or more sections that form the lower tubular portion of the junction subassembly.

4. The sealing joint system of claim 3, wherein the at least one or more sections are hollow.

5. The sealing joint system of claim 1, wherein the body is a unitary, integrally formed body.

6. The sealing joint system of claim 1, wherein the junction subassembly is comprised of a metal, a metal alloy, an elastomeric material or a rubber material.

7. The sealing joint system of claim 6, wherein the metal comprises aluminum or magnesium.

8. The sealing joint system of claim 6, wherein the metal alloy is calcium-magnesium (Ca—Mg) alloys, calcium-aluminum (Ca—Al) alloys, calcium-zinc (Ca—Zn) alloys, magnesium-lithium (Mg—Li) alloys, aluminum-gallium (Al—Ga) alloys, aluminum-indium (Al—In) alloys, aluminum-gallium-indium alloys (Al—Ga—In), or combinations thereof.

9. The sealing joint system of claim 1, wherein the junction subassembly is comprised of an organic polymer.

10. The sealing joint system of claim 9, wherein the organic polymer is a polymeric composition.

11. The sealing joint system of claim 10, wherein the polymeric composition is a cross-linked polymer, thermoplastic or elastomer.

12. The sealing joint system of claim 1, wherein the junction subassembly is comprised of epoxy or a nano-structured material.

13. The sealing joint system of claim 1, wherein the lower tubular portion includes angled sections.

14. The sealing joint system of claim 1, wherein the junction subassembly is coupled to a drillable packer or drillable cement plug.

15. A method of sealing a junction between adjacent wellbores, comprising:

placing a whip stock in a parent wellbore; and using the whip stock to place a dissolvable sealing joint into a liner in a secondary wellbore, the dissolvable sealing joint being connected to a packer assembly and comprising:

a junction subassembly having upper and lower portions and a fluid port located therein, the lower portion having a no-go shoulder defining a tapered end; and a sealing member located about the tapered end and adjacent the no-go shoulder, and wherein the junction subassembly is comprised of a dissolvable material;

pumping an isolation fluid through the fluid port to seal a junction region located adjacent the parent and secondary wellbores;

removing the packer assembly and at least partially dissolving the junction subassembly; and removing the whip stock.

16. The method of claim 15, wherein at least partially dissolving includes chemical dissolution of the junction subassembly or mechanical disintegration of the junction subassembly.

17. The method of claim 16, wherein at least partially dissolving comprises exposing the junction subassembly to a catalyst solution that reacts with the composition of the junction subassembly which dissolves the junction subassembly, wherein the catalyst solution is hydrochloric acid, nitric acids, sulfuric acid, potassium chloride, tetrahydrofuran (THF), methyl acetate (MA), isopropanol and methanol or combinations thereof.

18. The method of claim 16, wherein mechanical disintegration comprises drilling-out the junction subassembly.

19. The method of claim 15, further comprising removing the whip stock by chemical dissolution, mechanical disintegration, or physical removal of the whip stock from the parent wellbore.

* * * * *